US006108624A

United States Patent [19]

Park

[11] Patent Number: 6,108,624

[45] Date of Patent: Aug. 22, 2000

[54] METHOD FOR IMPROVING PERFORMANCE OF A VOICE CODER

[75] Inventor: Ho-chong Park, Sungnam, Rep. of Korea

[73] Assignee: Samsung Electronics Co., Ltd., Rep. of Korea

[21] Appl. No.: 09/150,362

[22] Filed: Sep. 9, 1998

[30] Foreign Application Priority Data

Sep. 10, 1997 [KR] Rep. of Korea ..... 97-46506
Dec. 3, 1997 [KR] Rep. of Korea ..... 97-65487

[51] Int. Cl.[7] ..... G10L 19/12

[52] U.S. Cl. ..... 704/221

[58] Field of Search ..... 704/219, 221, 704/222

[56] References Cited

U.S. PATENT DOCUMENTS

| | | | |
|---|---|---|---|
| 4,980,916 | 12/1990 | Zinser | 381/36 |
| 5,060,269 | 10/1991 | Zinser | 381/38 |
| 5,138,661 | 8/1992 | Zinser et al. | 381/35 |
| 5,307,460 | 4/1994 | Garten | 395/2.28 |
| 5,327,519 | 7/1994 | Haggvist et al. | 395/2.28 |
| 5,487,128 | 1/1996 | Ozawa | 704/222 |
| 5,583,888 | 12/1996 | Ono | 375/240 |
| 5,598,504 | 1/1997 | Miyano et al. | 704/222 |
| 5,602,961 | 2/1997 | Kolesnik et al. | 704/223 |
| 5,651,090 | 7/1997 | Moriya | 704/222 |
| 5,701,294 | 12/1997 | Ward et al. | 370/252 |
| 5,751,903 | 5/1998 | Swaminathan et al. | 395/2.39 |
| 5,797,119 | 8/1998 | Ozawa | 704/223 |

OTHER PUBLICATIONS

Serizawa et al, "4 kbps improved pitch prediction CELP speech coding with 20 ms frames", ICASSP, vol. 1 pp 1–4, May 9, 1995.

Zlieng et al, "On the Use of Band–passed Excitation Codebooks for CELP Coding of Speech",IEEE Workshop on Speech Coding for Telecommunications, pp. 105–106, Oct. 1993.

Chang et al, "A speech coder with low complexity and optimized codebook", IEEE TENCON, pp. 621–624, Dec. 1997.

Yang et al,"A robust and fast DP–CELP vocoder at the bit rate of 4 kb/s",ISSIPNN, PP. 563–566, Apr. 13, 1994.

Ramirez et al,"A multistage search of algebraic CELP codebooks", pp. 17–20; Mar. 15, 1999.

Gersho et al,"Vector Quantization adn Signal Compression", pp. 594–605, 1992.

*Primary Examiner*—Krista Zele
*Assistant Examiner*—Michael N. Opsasnick
*Attorney, Agent, or Firm*—Dilworth & Barrese

[57] ABSTRACT

This invention relates to a method for improving performance of voice coder. A target signal is calculated for a window, and the optimal candidate codebooks and optimal candidate codebook gains from the target signal for the window are searched for all codebook indices and all codebook optimal gains. Target signals for a second subframe are then calculated from the target signal for the window, optimal candidate codebooks and optimal candidate codebook gains for the first subframe. The optimal candidate codebooks and optimal candidate codebook gains for the second subframe from the target signal for the second subframe are searched and the optimal candidate codebooks and optimal candidate codebook gains for the first subframe are searched. The optimal codebook and optimal codebook gain for two subframes are selected from the respective target signal for the window, optimal candidate gains and all possible quantized gains for the first subframe and optimal candidate codebooks and optimal candidate codebook gains for the second subframe.

9 Claims, 12 Drawing Sheets

METHOD FOR IMPROVING PERFORMANCE OF A VOICE CODER

FIELD OF THE INVENTION

The invention relates to voice coders and more particularly, to a method for improving performance of voice coder using a new codebook search technology.

DESCRIPTION OF THE RELATED ART

A voice coder reduces the amount of data by transmitting a residual signal instead of all input voice signals, where the residual signal corresponds to a difference value between a predicted signal based on previous information and an original input signal.

It is possible to predict input voice signals s(n) during a time axis n between 30 ms and 40 ms, by using previous voice signals including s(n−1), s(n−2),.

The predicted voice signals based on previous voice signals are expressed according to the following Equation 1;

$$s'(n)=a_1s(n-1)+a_2s(n-2)+a_3s(n-3)+\ldots+a_{10}s(n-10) \quad (1)$$

As a result, s' (n) can be reconstructed by transmission of the above coefficients instead of transmission of all voice signals.

A Linear Prediction Coefficient (LPC) filter is used for determining the above coefficients. The LPC filter, also called a spectrum filter, uses an auto-correlation technique to determine LPC coefficients up to a tenth-order for a time variable n.

However, the s' (n) predicted through the above-stated process is not completely identical to the original signal and in addition, the pitch of voice is unpredictable.

A pitch analysis is performed to obtain information about pitch period corresponding to a long-term correlation of the voice signal. Since pitch periods of voice vary and are compiled in a codebook, the corresponding pitch period can be found from the codebook by the transmission of an index. A pitch filter removes correlation based on the pitch period of voiced sound from the residual signal filtered by the LPC filter.

The original voice can be reconstructed using the final residual signal, the LPC coefficients and the pitch filter parameters. The LPC coefficients and the pitch filter parameters are determined to minimize the error signal by using the input voice signal, and the determined LPC coefficients, pitch parameters and residual signals must be quantized for digital transmission.

A voice coder is differentiated based on how it quantizes the residual signals.

A Code Excited Linear Predictive (CELP) voice coder uses a codebook to quantize a residual signal. In other words, the CELP voice coder selects the signal closest to the residual signal among prepared codebooks and transmits the codebook index to a receiver. When the receiver uses the same codebook, the receiver obtains the residual signal with transmitted index.

The CELP voice coder is designed to select a signal to optimize a given fidelity among signals obtained by passing excited input signals stored in a codebook through two time-varying linear recursive filters such as a pitch filter and a LPC filter.

To determine the fidelity of two signals, the mean square errors of the two signals are gradually compared. The CELP voice coder achieves a high quality voice by using an analysis-by-synthesis, where an input voice signal is analyzed and is compared with synthesized signals using determined parameters.

The analysis-by-synthesis comprises calculating a synthesized voice signal over each of all possible codebooks and finally selecting the synthesized voice signal closest to the original voice signal.

Generally, an input voice signal is divided into subframes, each of which consists of 20 samples (one sample equals 0.125 ms). One optimal codebook is selected per subframe.

Along with a codeword required to choose a synthesized signal, a quantized codebook gain required to reconstruct the signal is selected from the codebook. The pitch signal is found by multiplying the codeword selected using an index with the quantized codebook gain, also selected by an index.

How to find the characteristic function of each filter, and how to search codebook and codebook gain are most important for coding a voice signal using a voice coder as described above.

A codebook gain search, which must be performed on each voice signal requires a large amount of computation. FIG. 1 is a block diagram illustrating a codebook search method according to the prior art. FIG. 2 is a flow chart corresponding to FIG. 1 and illustrating a codebook search method according to the prior art. Each block of FIG. 1 corresponds to each step in FIG. 2 having the same reference numeral. It is assumed that characteristic functions of a LPC filter, pitch filter and weighting filter are determined as 1/A(z), 1/P(z) and 1/W(z) respectively prior to selecting a codebook.

As described in FIGS. 1 and 2, the codebook search method includes the following steps of: pitch filtering a zero-input (s110); LPC filtering the pitch filtered signal (s120); weighting filtering a difference value between an input voice signal and the LPC filtered signal (s130); searching all codebooks from all codebook indices (s140); LPC filtering multiplication of the searched codebook and all quantized gains (s150); and selecting an optimal codebook and quantized gain to minimize a mean square error of a difference value between the weighting filtered signal (1) and the LPC filtered signal (2) (s160).

First, the pitch filter produces a zero-input response, which is used as an input to the LPC filter. After subtracting an output signal of the LPC filter from input voice signal, a weighting filter produces a target signal (1) using the result. LPC filter then produces an output signal (2) by filtering all possible codebooks and all quantized gains from codebook index. Codebook and quantized gain are selected to minimize a mean square error between the target signal (1) and the output signal (2). Such procedure is performed for each of the subframes and optimization of codebook, and codebook gain is performed based on a difference between the target signal (1) within subframes and output signal (2).

Thus, the procedure for determining one optimal codebook and quantized gain must be performed every subframe.

As described above, codebook is determined independently for each subframe by means of optimization within each subframe. Then, the input voice signal for the current subframe is provided, and all previous information is provided as an initial value of each filter without effecting a codebook search.

However, a codebook search is performed without any information relating to the next signal. In a voice-varying region, particularly a transient region, optimization within a short-term subframe doesn't guarantee selection of an optimal codebook.

In addition, the problem of independent optimization for each subframe is that characteristics of the signal at the boundary are less replicated. The shorter the subframe is, the greater the problem of the subframe boundary.

A CELP standard voice coder according to the prior art used in the communication system provides poor quality in synthesizing voice due to the above reasons, and accordingly provides poor quality service of the communication system.

However, a great deal of money and time are required to set a new standard voice coder, because a large number of mobile stations and base station systems already use the prior art voice coder for providing cellular communication service.

SUMMARY OF THE INVENTION

The present invention provides a method for performing simultaneous optimization within two successive subframes. More particularly, the method searches codebooks by utilizing information on the next received input. A CELP voice coder according to a preferred embodiment of the present invention is compatible with the conventional CELP voice coder, and improves voice quality by changing the software of the conventional voice coder.

In a preferred embodiment of the present invention, a method for improving performance of voice coder comprises the steps of:

calculating a target signal for a window comprising two subframes;

determining K candidate optimal codebooks and K candidate optimal codebook gains for a first subframe from said target signal, all codebook indices and all codebook optimal gains;

calculating K target signals for a second subframe from said target signal for a window and said candidate optimal codebooks and candidate optimal codebook gains for the first subframe;

determining L candidate optimal codebooks and L candidate optimal codebook gains for a second subframe from said target signal for a second subframe and said candidate optimal codebooks and candidate optimal codebook gains for a first subframe; and selecting an optimal codebook and optimal codebook gain for said two subframes respectively from said target signal for a window, said candidate optimal gains and all possible quantized gains for said first subframe and said optimal codebook and candidate optimal codebook gains for said second subframe.

BRIEF DESCRIPTION OF THE DRAWINGS

The foregoing and other objects, features and advantages of the present invention will become more apparent from the following detailed description when taken in conjunction with the accompanying drawings in which.

DETAILED DESCRIPTION OF PREFERRED EMBODIMENTS

The method of the present invention improves a voice quality by a codebook search utilizing information on the next input and a simultaneous optimization within two successive subframes. Such improvement of the synthesized voice quality is achieved by a codebook search over wider band of voice.

Additionally, the present invention provides two methods for a simultaneous optimization of two successive subframes: one is to reduce the computational burden, and the other is to variably adjust the computational burden.

The two successive subframes through which a codebook search is performed, is defined as a window. Lc is a time interval of one subframe, and an index of a time axis is running from 0 to 2Lc−1. A first subframe corresponds to 0, 1, ., Lc−1 and a second subframe corresponds to Lc, Lc+1, ., 2Lc−1.

K candidate optimal codebooks for a first subframe are selected within each window, and L candidate optimal codebooks for a second subframe are selected for each of the K determined candidate codebooks. As a result, K×L combinations are chosen. A search for all possible quantized codebook gains for the chosen K×L combination is performed on each window, and the optimal codebook combination and the corresponding quantized gain is determined.

Figure 1:
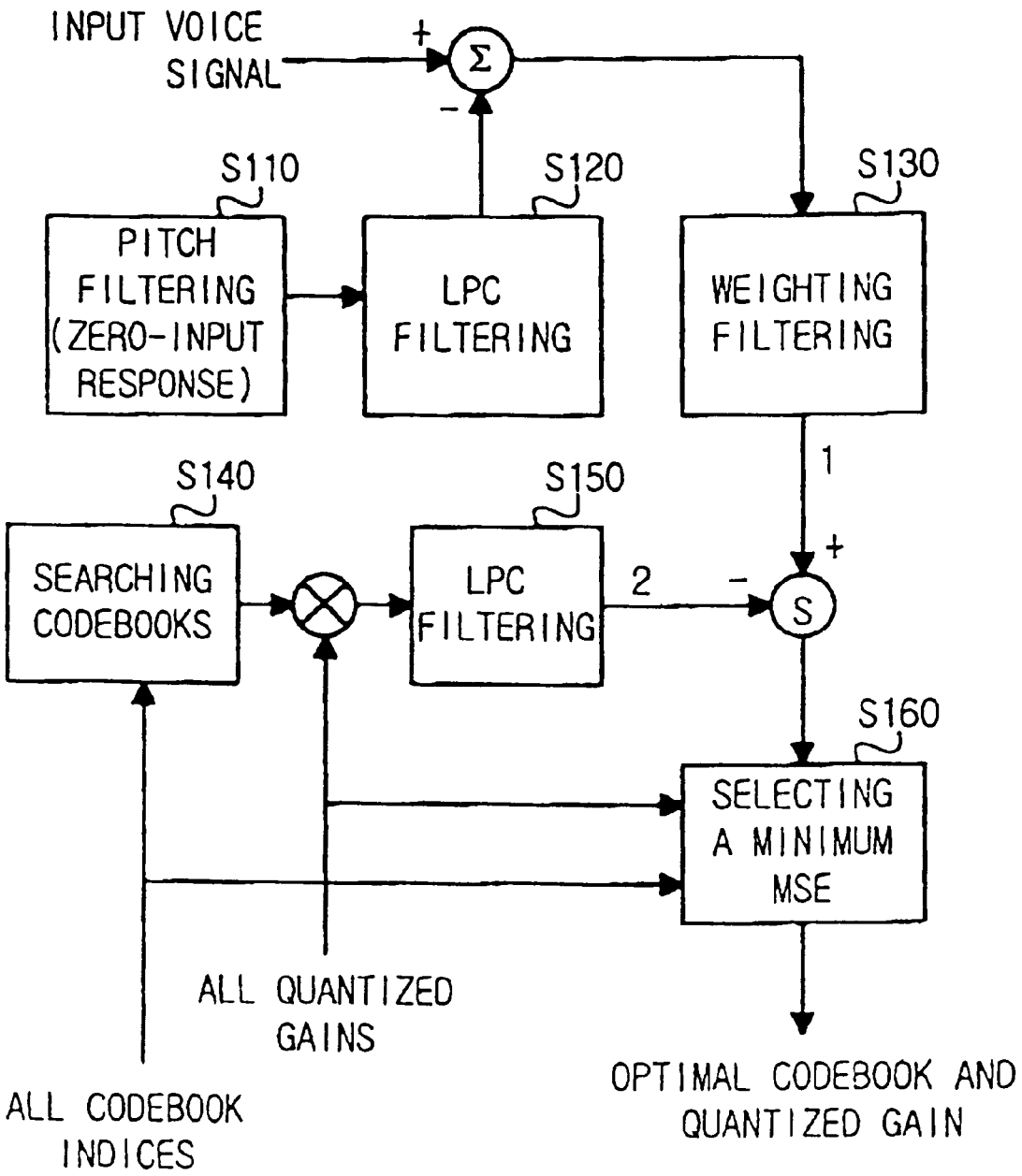
FIG. 1(PRIOR ART)
FIG. 1 is a block diagram illustrating a codebook search method according to a prior art.
Figure 2:
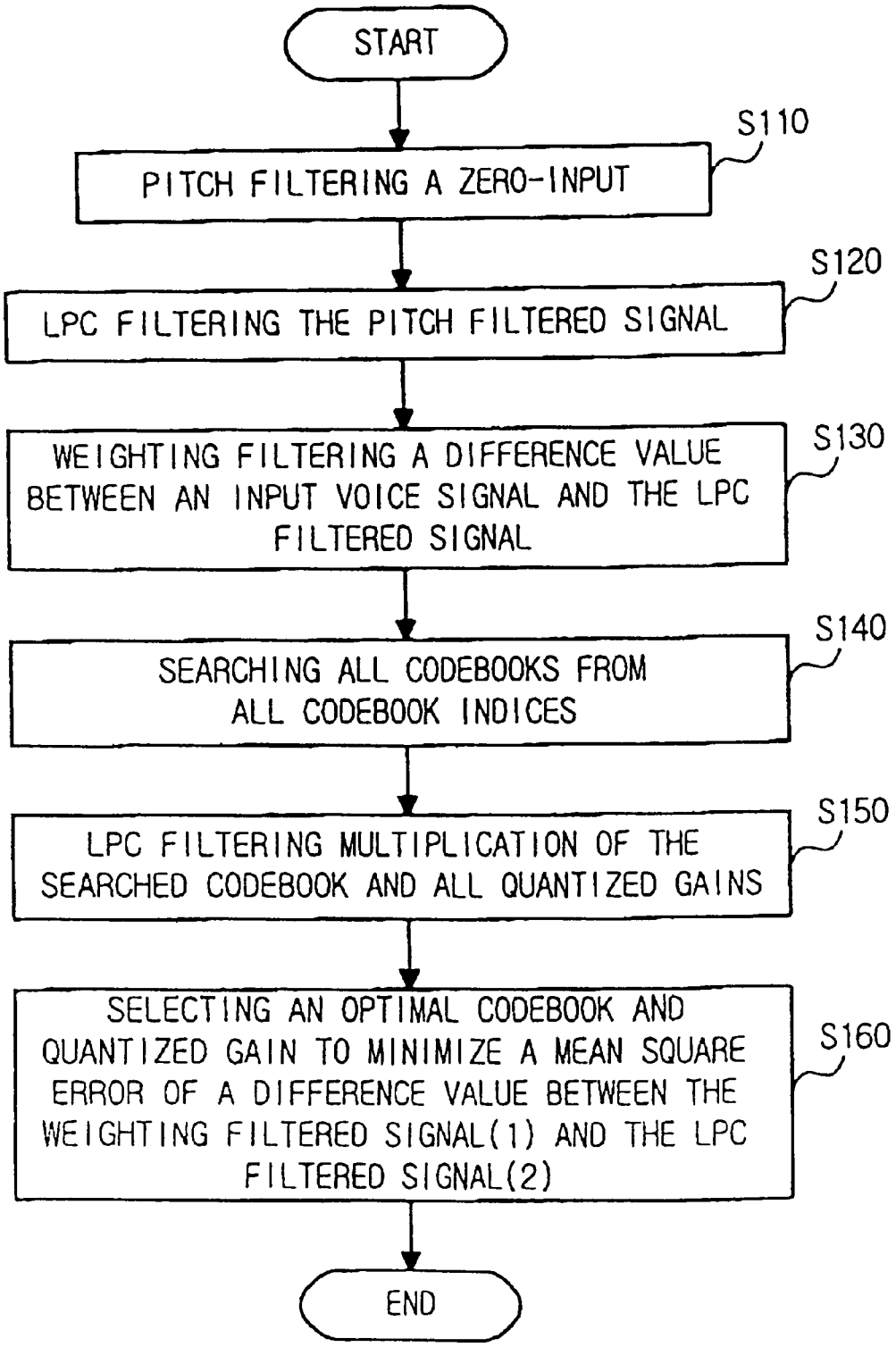
FIG. 2(PRIOR ART)
FIG. 2 is a flow chart illustrating a codebook search method according to the prior art.
Figure 3:
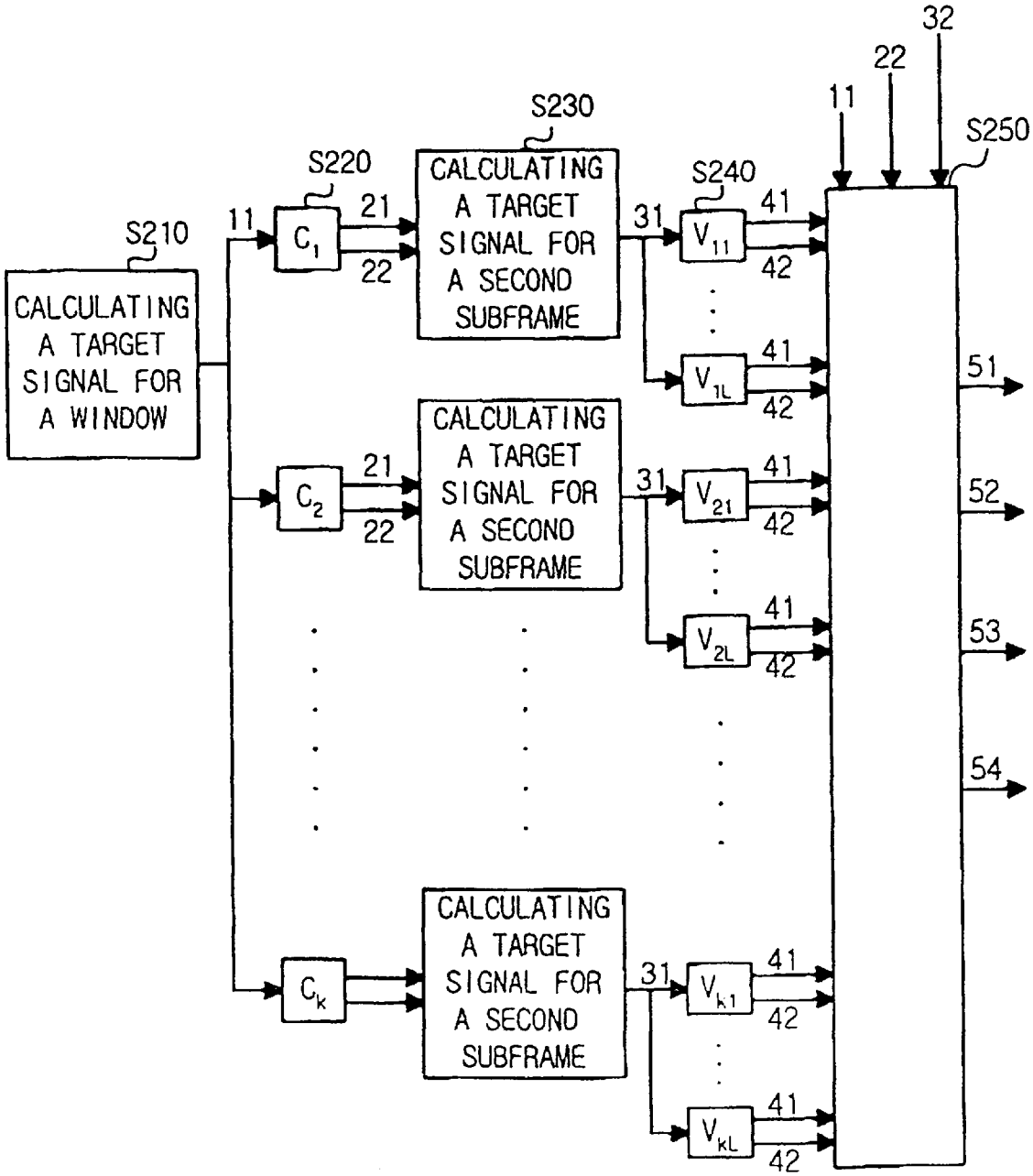
FIG. 3 is a block diagram illustrating a codebook search method according to an embodiment of the present invention.
Figure 4:
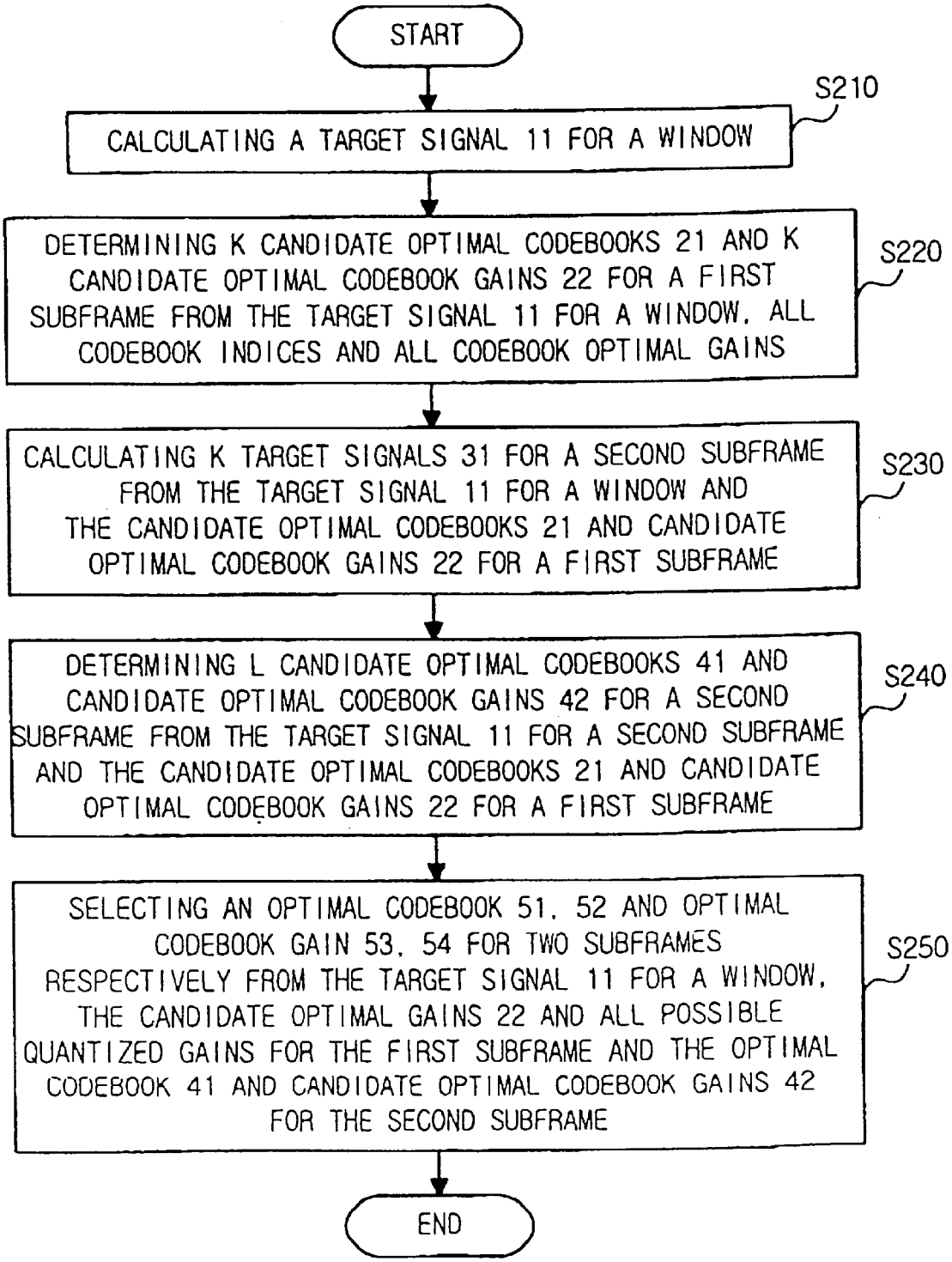
FIG. 4 is a flow chart illustrating a codebook search method according to an embodiment of the present invention.

FIG. 3 is a block diagram illustrating a codebook search method according a preferred embodiment of the present invention. FIG. 4 is a flow chart corresponding to FIG. 3 illustrating a codebook search method according to an embodiment of the present invention. Each block in FIG. 3 corresponds to each step of FIG. 4 having the same reference numeral.

As described, the method comprises the steps of: calculating a target signal 11 for a window (s210);

determining K candidate optimal codebooks 21 and K candidate optimal codebook gains 22 for a first subframe from the target signal 11 for a window, all codebook indices and all codebook optimal gains (s220);

calculating K target signals 31 for a second subframe from the target signal 11 for a window and the candidate optimal codebooks 21 and candidate optimal codebook gains 22 for a first subframe (s230);

determining L candidate optimal codebooks 41 and candidate optimal codebook gains 42 for a second subframe from the target signal 11 for a second subframe and the candidate optimal codebooks 21 and candidate optimal codebook gains 22 for a first subframe (s240); and selecting an optimal codebook 51, 52 and optimal codebook gain 53, 54 for two subframes respectively from the target signal 11 for a window, the candidate optimal gains 22 and all possible quantized gains for the first subframe and the optimal codebook 41 and candidate optimal codebook gains 42 for the second subframe (s250).

A codebook search technique will be presently explained in reference with the drawings. A pitch filter produces a zero-input response, which is used as an input to an LPC filter and the LPC filter produces an LPC filtered output signal in the same manner as in the prior art.

A subtracter subtracts the output of LPC filter from a voice signal corresponding to two subframes, and the subtracted output is used by a weighting filter, which provides a target signal for a window. The target signal for a window is used for optimal codebooks search for a first subframe.

Figure 5:
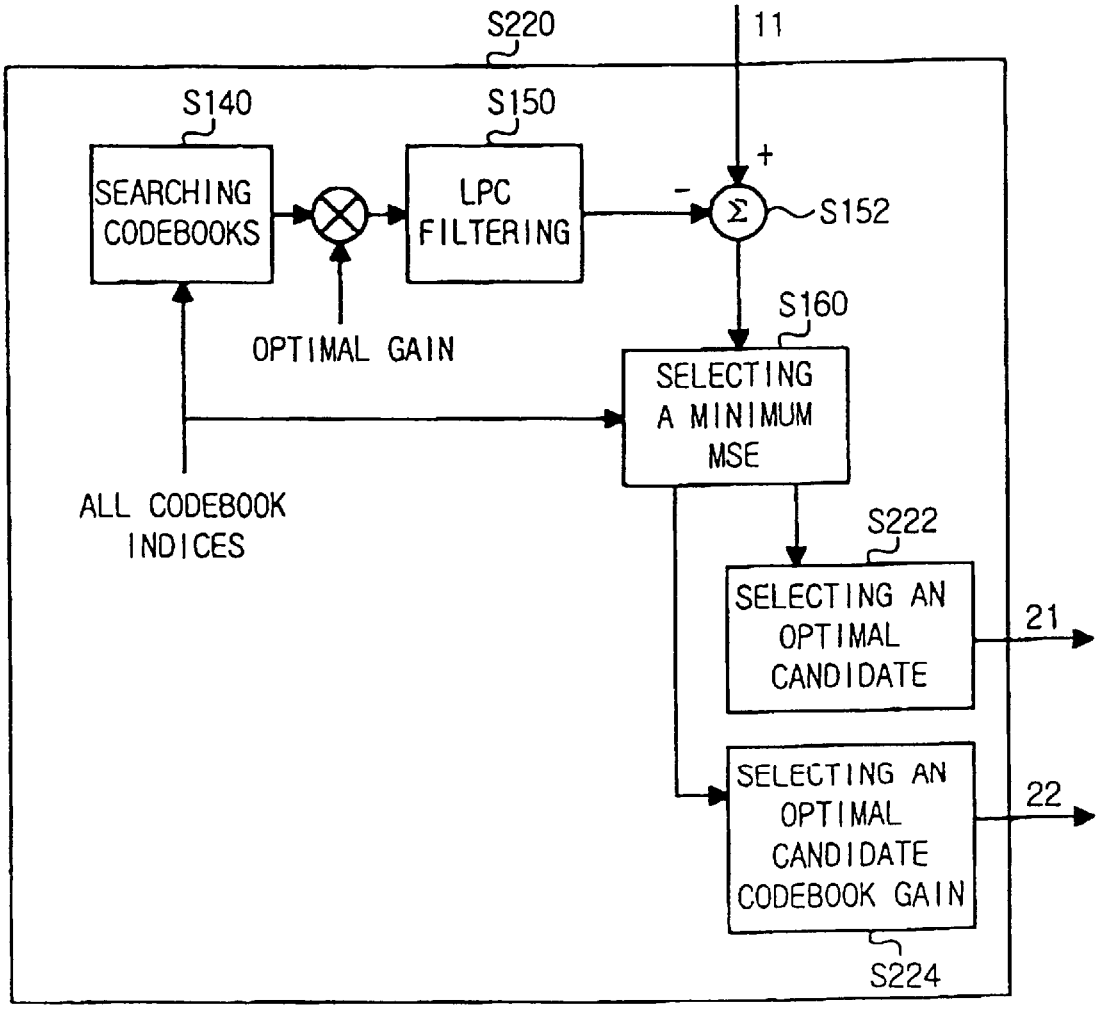
FIG. 5 is a block diagram illustrating an optimal codebook search method over a first subframe according to an embodiment of the present invention.
Figure 6:
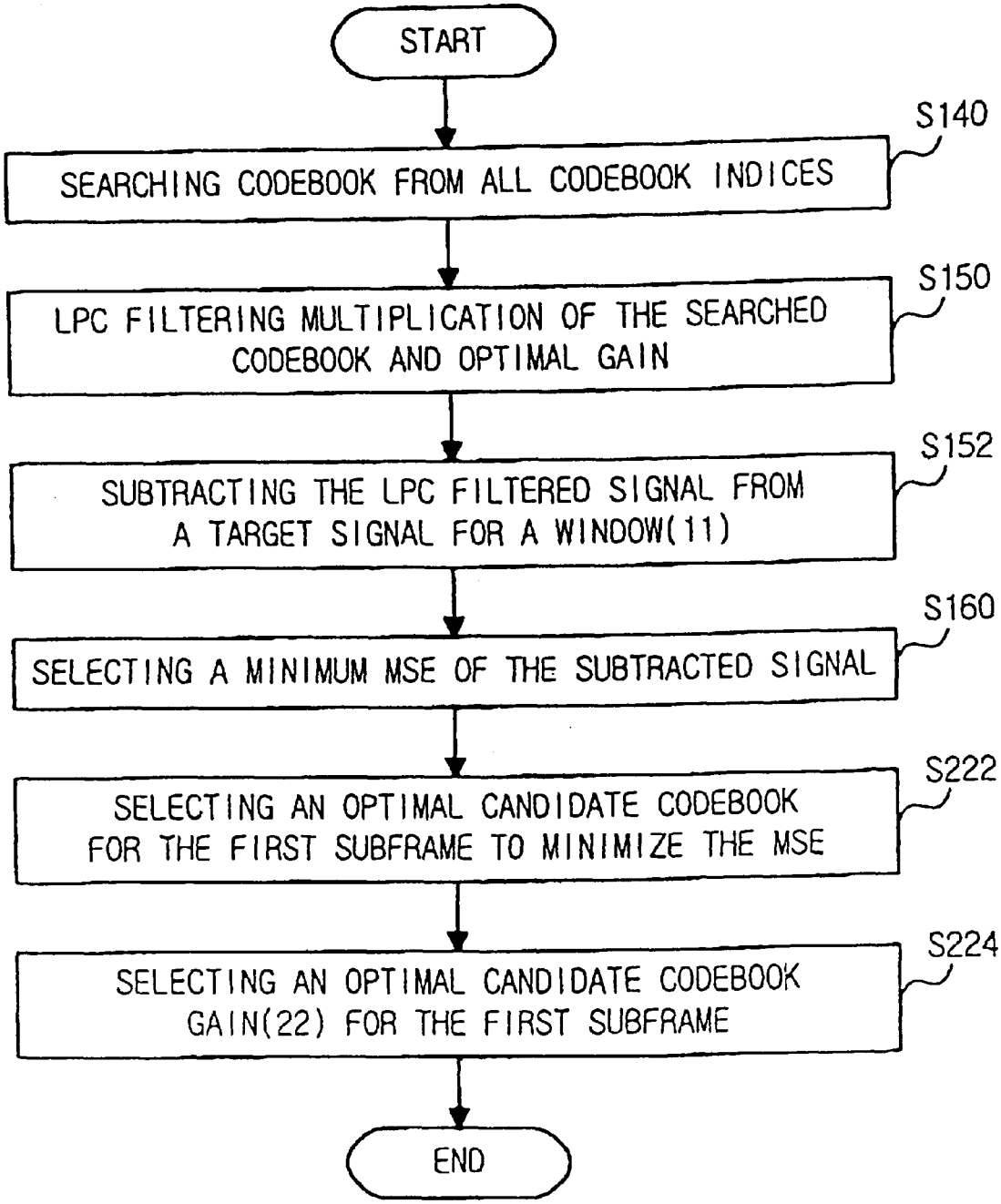
FIG. 6 is a flow chart illustrating a method for searching optimal candidate codebook and optimal candidate codebook gain for a first subframe according to the present invention.

FIG. 5 is a block diagram illustrating optimal codebook search method over a first subframe according to a preferred embodiment of the present invention. FIG. 6 is a flow chart corresponding to FIG. 5 illustrating a method for searching optimal candidate codebook and optimal candidate codebook gain for a first subframe according to the present invention. Each block in FIG. 5 corresponds to each step of FIG. 6 having the same reference numeral.

As described in FIGS. 5 and 6, the method for searching optimal candidate codebook further comprises the steps of: searching codebook from all codebook indices (s140); LPC filtering multiplication of the searched codebook and optimal gain (s150); subtracting the LPC filtered signal from a target signal 11 for a window (s152); selecting a minimum MSE of the subtracted signal (s160); selecting codebook candidate gain for the first subframe having the minimum MSE (s222); and selecting codebook candidate gain for the first subframe (s224). An LPC filter receives all possible codebooks and non-quantized codebook optimal gains and produces a filtered output signal.

In step s152 calculates a difference value between a target signal 11 for a window and the output signal, in steps s222 and s224, mean square error selector, respectively selects the candidate codebooks 21 and quantized gains 22 to minimize mean square error. Then, the optimization process is performed within a first subframe.

The above process determines K candidate optimal codebooks and K candidate optimal codebook gains for each of K codebooks. For selected K pairs of candidate codebook and candidate codebook gains, a target signal corresponding to each second subframe is calculated.

Figure 7:
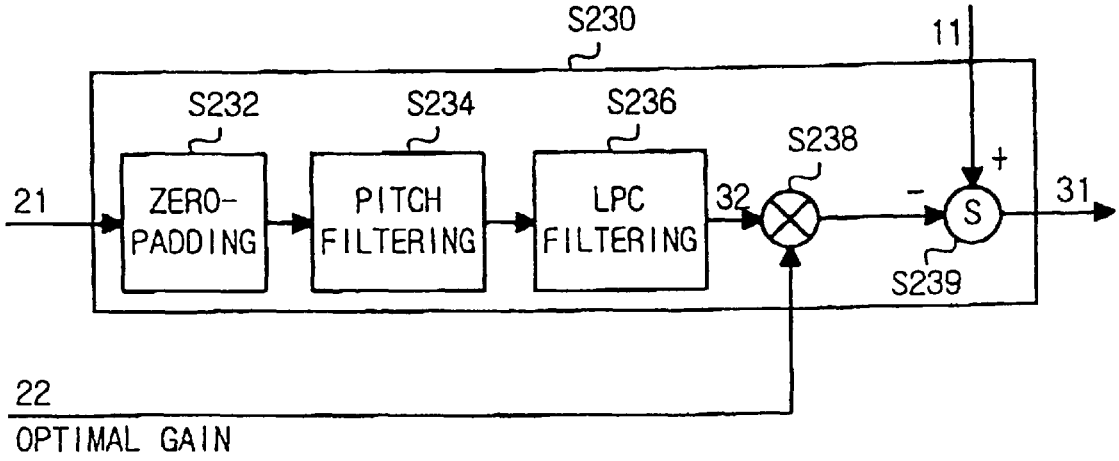
FIG. 7 is a block diagram illustrating a method for calculating a target signal for a second subframe according to an embodiment of the invention.
Figure 8:
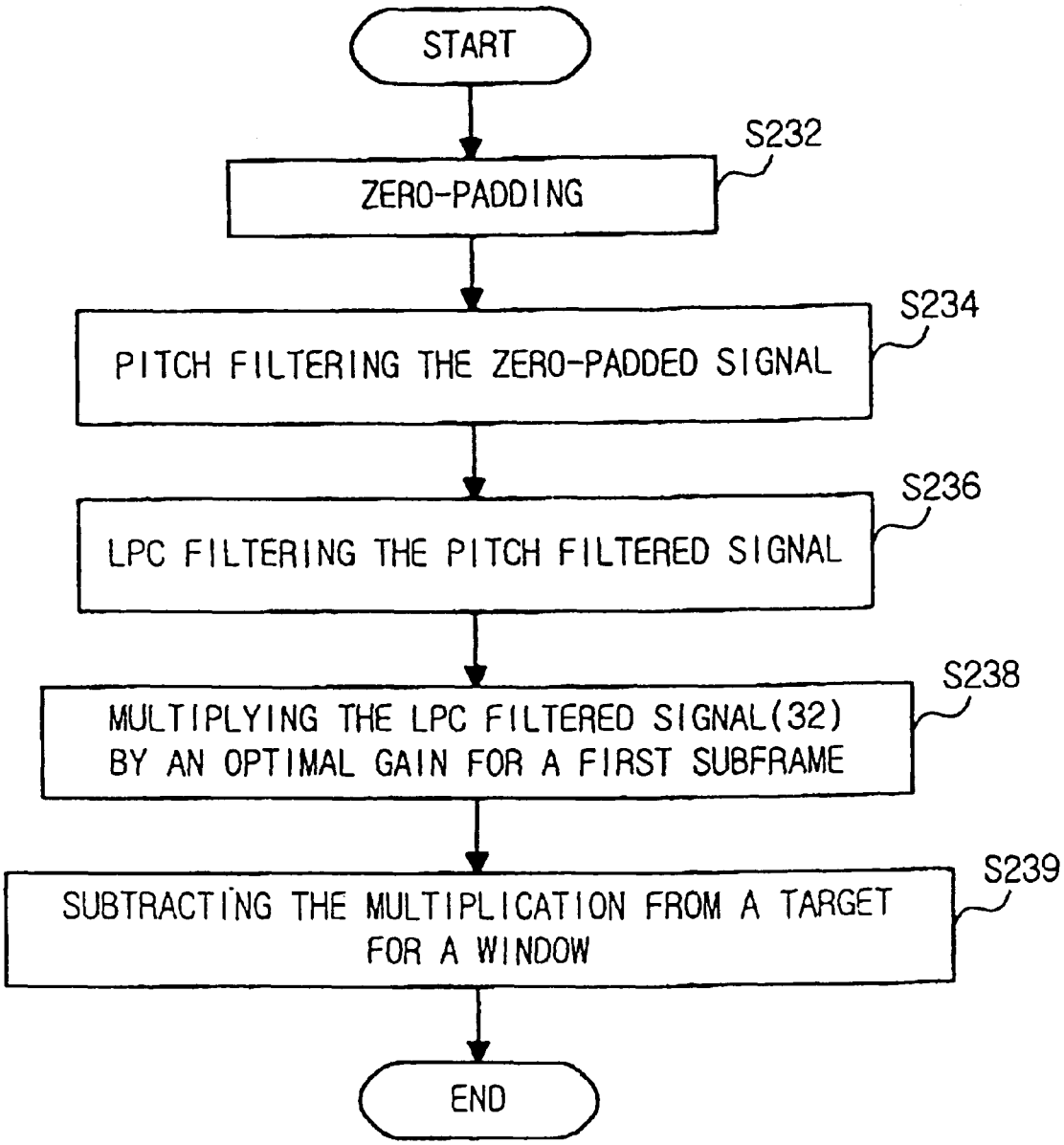
FIG. 8 is a flow chart illustrating a method for calculating a target signal for a second subframe according to an embodiment of the invention.

FIG. 7 is a block diagram illustrating a method for calculating a target signal for a second subframe according to an embodiment of the invention. FIG. 8 is a flow chart corresponding to FIG. 7 illustrating a method for calculating a target signal for a second subframe according to an embodiment of the invention. Each block of FIG. 7 corresponds to each step of FIG. 8 having the same reference numeral. The method for calculating a target signal for a second subframe further comprises the steps of: zero-padding the positions of a time axis Lc, Lc+1, . . . , 2Lc−1 corresponding to a second subframe (s232); pitch filtering the zero-padded signal (s234); LPC filtering the pitch filtered signal (s236); multiplying the LPC filtered signal 32 by an optimal gain for a first subframe (s238); and subtracting the multiplication from a target for a window (s239).

The positions of a time axis Lc, Lc+1, . . . , 2Lc−1 corresponding to a second subframe are padded by zero for each of the candidate codebooks for a first subframe and an output signal is produced by making the above result pass through a pitch filter and LPC filter. At this time, all the initial values of the pitch filter and LPC filter are set as "0" and filtered.

In step s238, a multiplier multiplies the output signal 32 by the candidate optimal codebook gain 22 for the first subframe. Subtractor 239 subtracts the above result from the target signal 11 and produces a target signal 31 for the second subframe.

Figure 9:
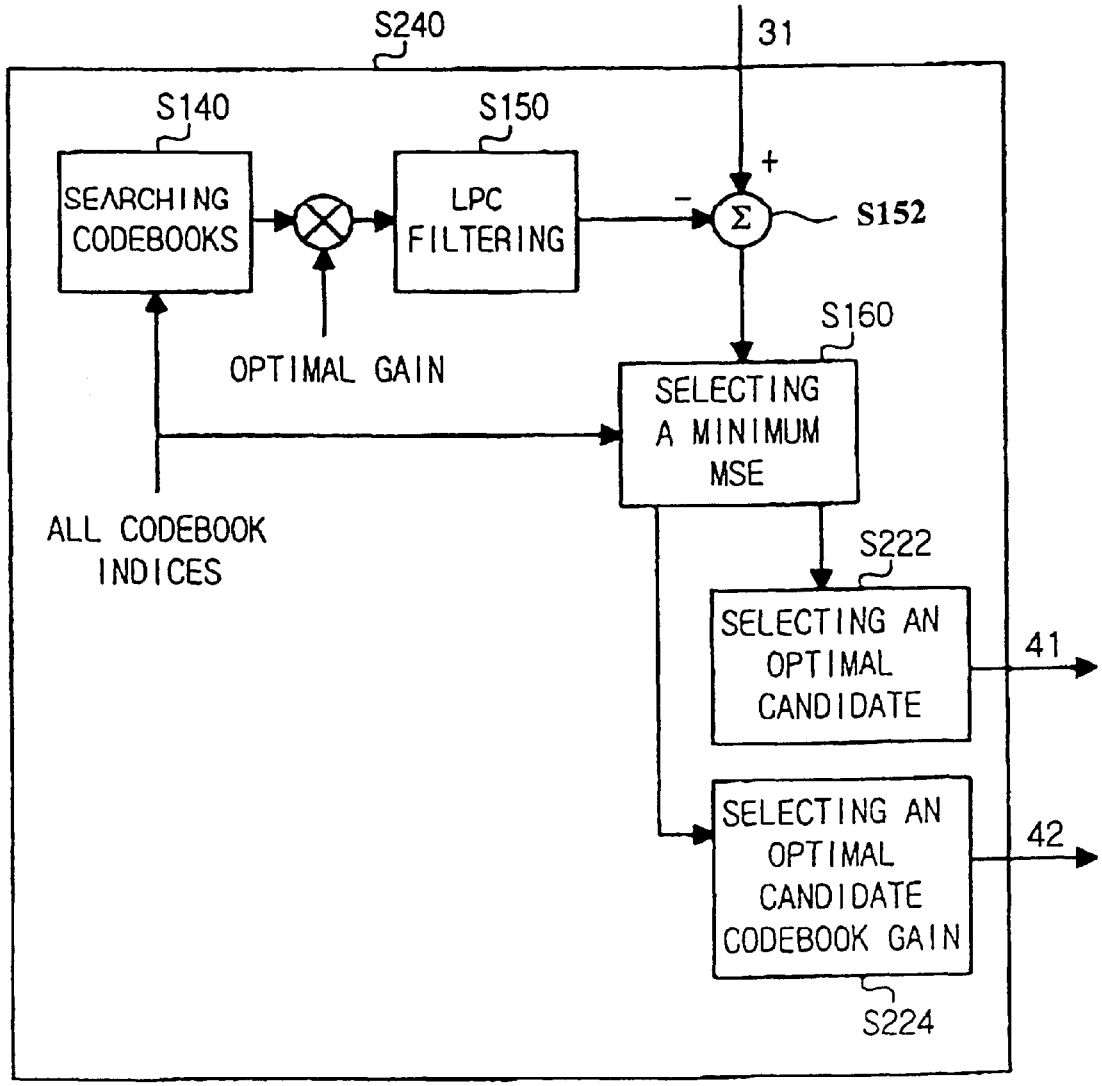
FIG. 9 is a block diagram illustrating an optimal codebook search method over a second subframe according to an embodiment of the present invention.
Figure 10:
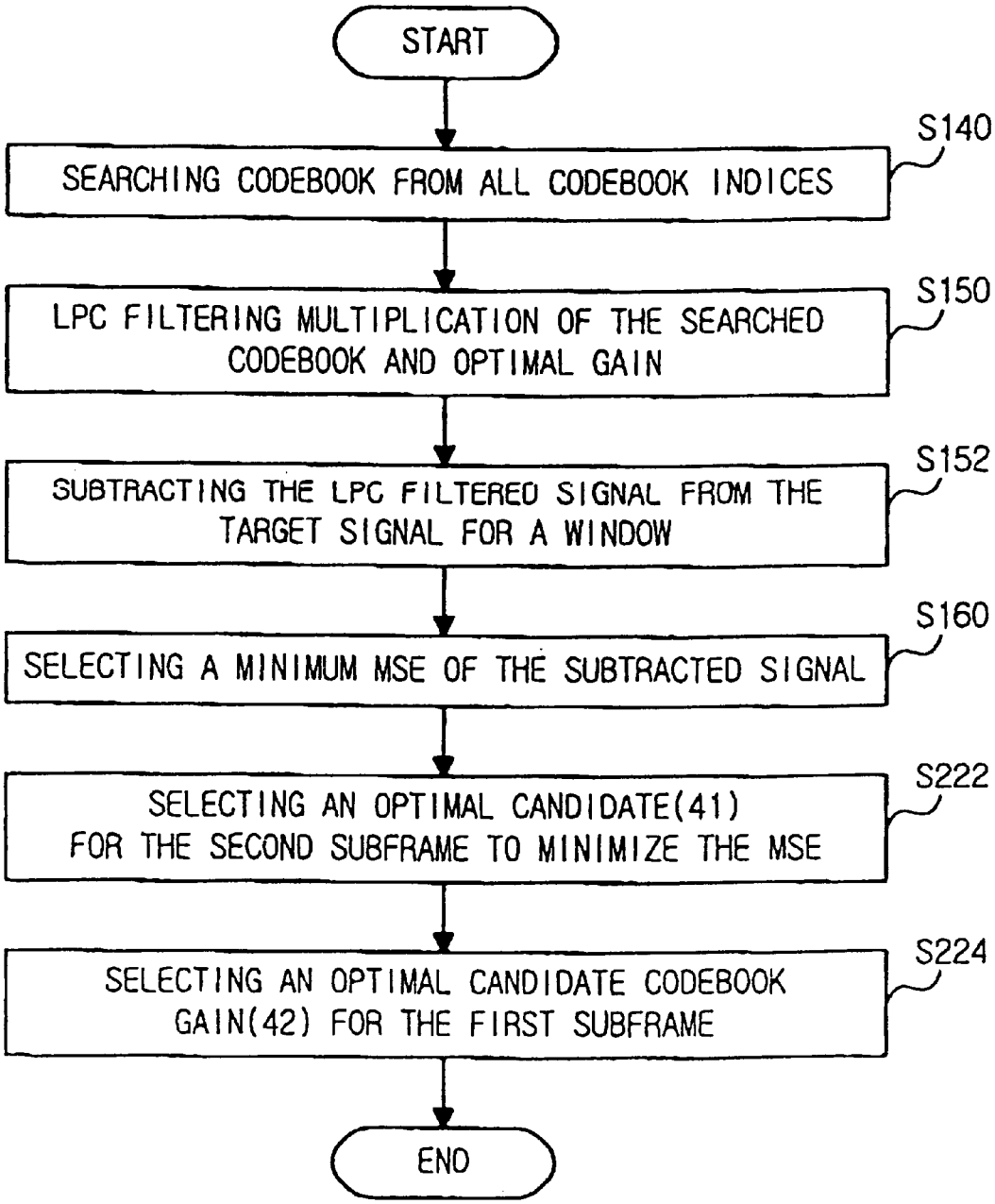
FIG. 10 is flow chart illustrating an optimal codebook search method over a second subframe according to an embodiment of the present invention.

FIG. 9 is a block diagram illustrating an optimal codebook search method over a second subframe according to an embodiment of the present invention. FIG. 10 is a flow chart corresponding to FIG. 9 and illustrating an optimal codebook search method over a second subframe according to an embodiment of the invention. Each block of FIG. 9 corresponds to each step of FIG. 10 having the same reference numeral.

The optimal codebook search method further comprises the steps of: searching codebook from all codebook indices (s140); LPC filtering multiplication of the searched codebook and optimal gain (s150); subtracting the LPC filtered signal from the target signal for a window (s152); selecting a minimum MSE of the subtracted signal (s160); selecting an optimal candidate gain 41 for the second subframe having the minimum MSE (s222); and selecting a candidate codebook gain 42 for the first subframe (s224). A LPC filter receives all possible codebook and optimal codebook gains and produces an output signal.

In step s152, a subtractor calculates a difference value between the output signal and the target signal 31 for the second subframe and minimum mean square error selector selects candidate codebooks and quantized candidate gains to minimize mean square error.

Then, a time axis from 0 to Lc−1 corresponding to the first subframe at each of the candidate codebooks 41 becomes "0".

Finally, the search for optimal codebook 51, 52 and quantized gain 53, 54 of two subframes is performed by utilizing candidate codebook 41 for the second subframe, quantized candidate codebook gains 42 and other information.

Figure 11:
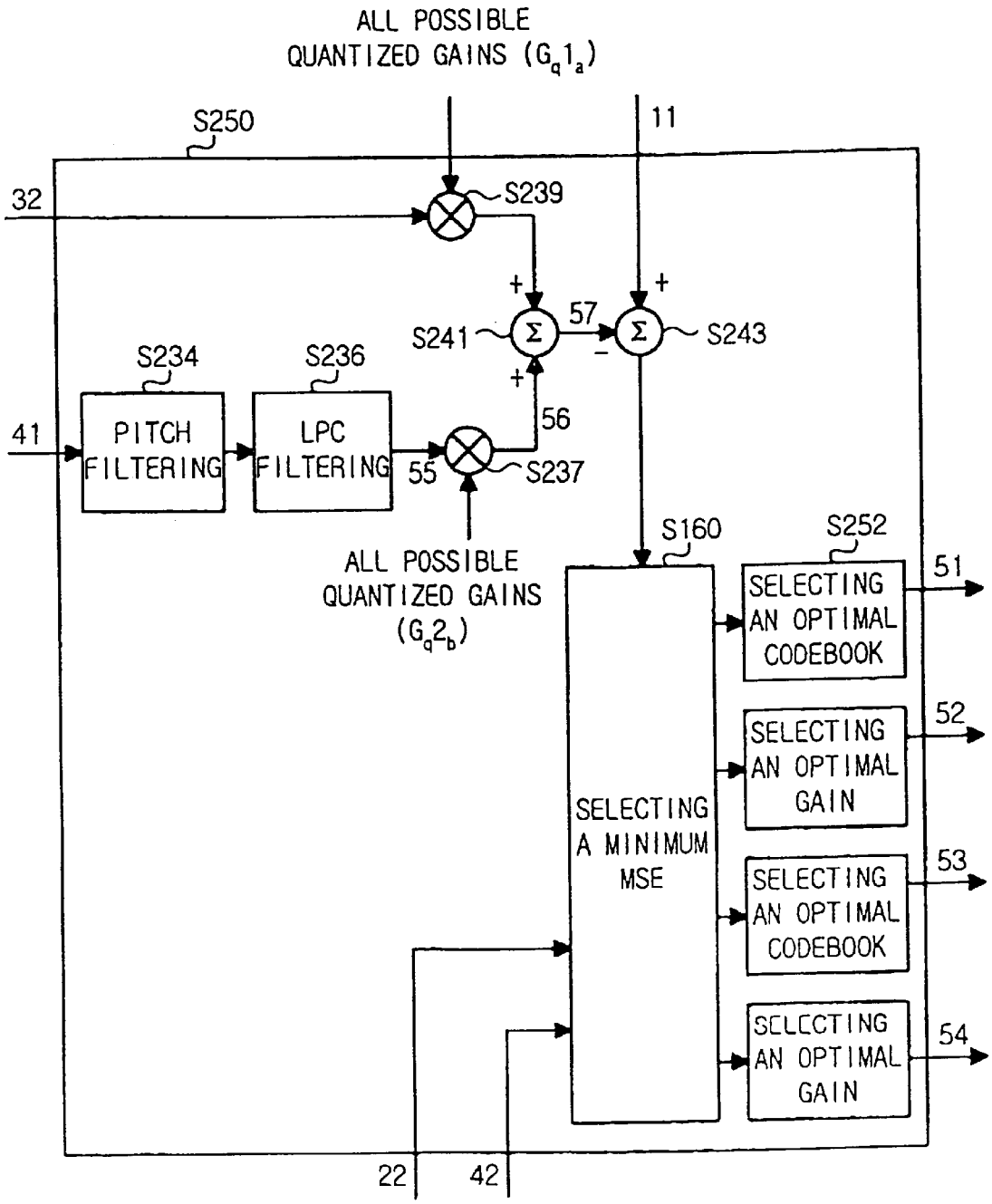
FIG. 11 is a block diagram illustrating an optimal codebook and a quantized gain search method according to an embodiment of the present invention.
Figure 12:
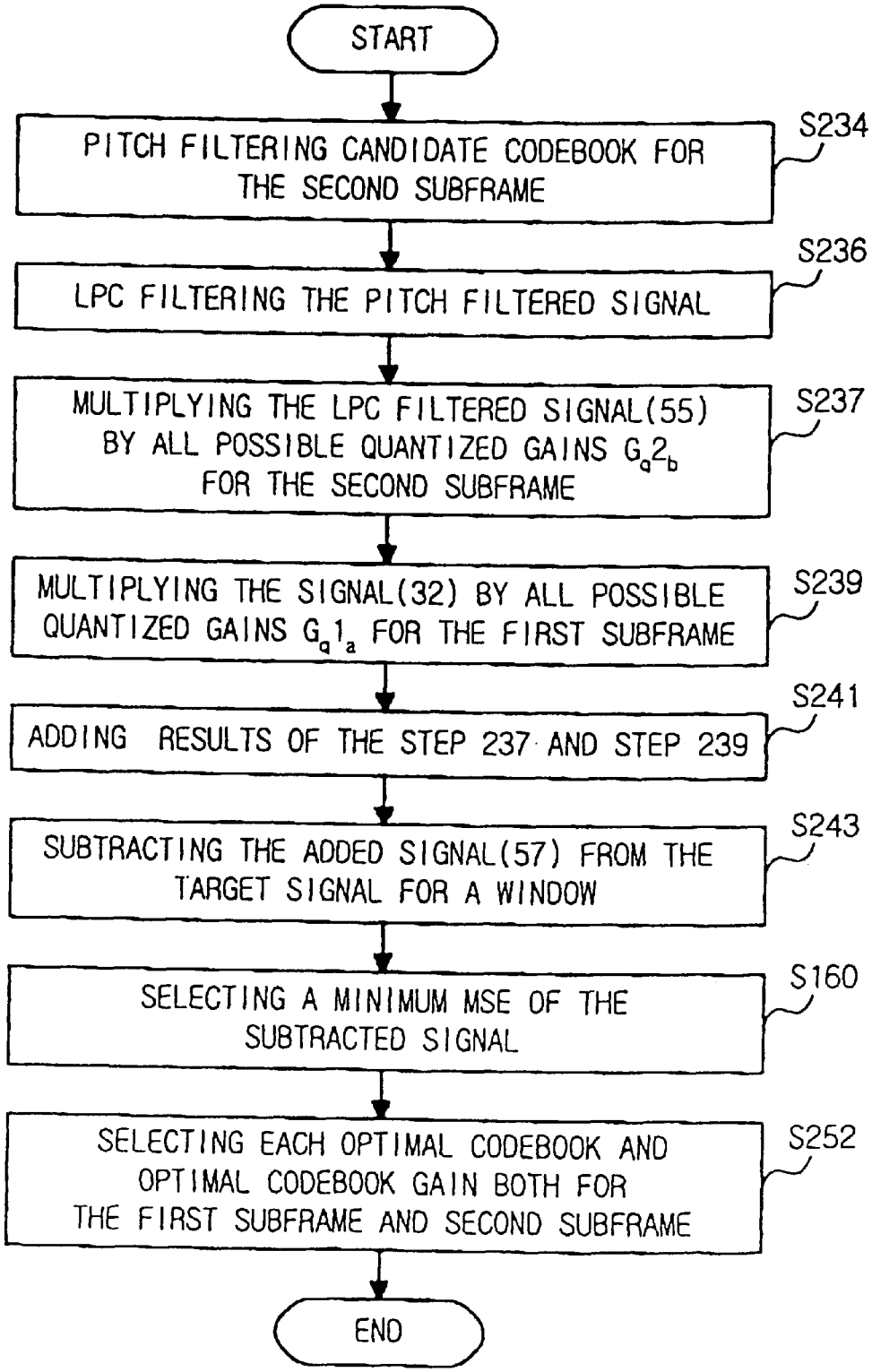
FIG. 12 is a flow chart illustrating the optimal codebook and a quantized gain search method according to an embodiment of the invention.

FIG. 11 is a block diagram illustrating an optimal codebook and quantized gain search method according to a preferred embodiment of the present invention. FIG. 12 is a flow chart corresponding to FIG. 11 illustrating the optimal codebook and a quantized gain search method according to an embodiment of the present invention. Each block of FIG. 11 corresponds to each step of FIG. 12 having the same reference numeral.

The optimal codebook and quantized gain search method further comprises the steps of: pitch filtering candidate codebook for the second subframe (s234); LPC filtering the pitch filtered signal (s236); multiplying the LPC filtered signal 55 by all possible quantized gains Gq2*b* for the second subframe (s237); multiplying the signal 32 by all possible quantized gains Gq1*a* for the first subframe (s239); adding results of the step (s237) and (s239)(s241); subtracting the added signal 57 from the target signal for a window (s243); selecting a minimum MSE of the subtracted signal (s160); and selecting a codebook and gain for the first subframe and a codebook and gain for the second subframe to minimize the MSE (s252). Candidate codebooks 41 for the second codebook are filtered through a pitch filter and LPC filter and multiplier 232 multiplies the filtered output signal 55 by all quantized codebook gains Gq2*b* and produces an output signal 56.

In step s239, a multiplier multiplies the output signal 32 from s230 by all possible quantized gains Gq1*a*. The result is added by adder to the signal 56 to produce output signal 57.

Finally, in step s243, a subtractor calculates a difference value between a target signal for a window 11 and the output signal 57 and mean square error selector selects codebooks 51, 53 and gains 52, 54 to minimize the mean square error.

Then, k, j, a, and b are determined to minimize a value according to equation 2.

$$\sum_{n=0}^{2L_c-1}[x(n)-Gq1_aU_k(n)-Gq2_bZ_j(n)]^2 \quad (2)$$

where n denotes a time axis running from 0 to 2–1;

x(n) denotes a target signal for a window;

$U_k$ (n) denotes the kth candidate optimal codebook for a first subframe;

$Z_j$ (n) denotes the jth candidate optimal codebook for a second subframe;

Gq1$_a$ denotes the ath quantized candidate codebook gains for a first subframe; and Gq2$_b$ denotes the bth quantized candidate codebook gains for a second subframe.

In a preferred embodiment, the present invention simultaneously quantizes two gains per window consisting of two subframes, while the prior art quantization is performed per subframe. Consequently, in the procedure to minimize equation 2, all possible quantized gains are not searched, i.e., all a and b of k and j respectively are not searched, but only quantized gains having the same positive or negative sign as the candidate optimal gains of each codebook 22 and 42 are searched. For example, when the optimal gain for a codebook of the first subframe is positive, the search is performed on only positive gains among all values.

This method reduces search time to ¼ of the time required for the prior art method of searching all optimal gains.

The method according to a preferred embodiment of the present invention first determines the K and L codebooks respectively for a first and second subframe within a window, and later selects one optimal combination from K×L combinations. Since the search time depends on K and L accordingly, the present invention adjusts the search time per frame by varying K and L.

The CELP voice coder of the present invention is compatible with a previous standard coder and improves the voice quality without algorithmic delay.

While the invention is susceptible to various modification and alternative forms, specific embodiments thereof have been shown by way of example in the drawings and detected description. It should be understood, however, that the present invention is not limited to the particular forms disclosed, but on the contrary, the intention is to cover all modifications, equivalents, and alternative falling within the spirit and scope of the invention as defined by the appended claims.

What is claimed is:

1. A method for improving performance of a voice coder comprising the steps of:

calculating a target signal for a window;

determining K optimal candidate codebooks and K optimal candidate codebook gains for a first subframe from said target signal for a window, all codebook indices and all optimal codebook gains;

calculating K target signals for a second subframe from said target signal for a window and said optimal candidate codebooks and optimal candidate codebook gains for the first subframe;

determining L optimal candidate codebooks and L optimal candidate codebook gains for a second subframe from said target signal for the second subframe and said optimal candidate codebooks and optimal candidate codebook gains for the first subframe; and selecting an optimal codebook and optimal codebook gain for said two subframes respectively from said target signal for a window;

selecting optimal candidate gains and all possible quantized gains for said first subframe; and selecting optimal codebook and optimal candidate codebook gains for said second subframe.

2. The method as set forth in claim 1, wherein said K and L are variable.

3. The method as set forth in claim 1, wherein said step of determining K optimal candidate codebooks and K optimal candidate codebook gains for a first subframe, further comprises the steps of:

passing all possible codebooks and non-quantized codebook optimal gains through a Linear Prediction Coefficients (LPC) filter to produce an output signal;

calculating a difference value between said output signal and said target signal for a window and selecting K pairs of candidate codebooks and quantized candidate gains to minimize a mean square error.

4. The method as set forth in claim 3, wherein in said step of selecting K pairs of candidate codebooks and quantized candidate gains, optimization for said first subframe is performed within said first subframe.

5. The method as set forth in claim 1, wherein said step of calculating K target signals for a second subframe further comprises the steps of:

zero padding with zeros the location of a time axis, Lc, Lc+1, ., 2Lc−1 corresponding to the second subframe for each codebook candidate for a first subframe selected in said step of determining K optimal candidate codebooks and candidate codebook gains; producing an output signal by passing said zero-padded signal through a pitch filter and LPC filter; and determining a target signal for the second subframe by subtracting said output signal multiplied by said optimal candidate gain for the first subframe from said target signal for a window.

6. The method as set forth in claim 5, wherein in said step of selecting K pairs of said candidate codebooks and quantized candidate gains, initial values of both said pitch filter and said LPC filter equal "0".

7. The method as set forth in claim 1, wherein said step of determining L optimal candidate codebooks and L optimal candidate codebook gains for a second subframe further comprises the steps of:

passing all possible codebooks and codebook optimal gains through a LPC filter to produce an output signal;

calculating a difference value between said output signal and said target signal for the second subframe and selecting L pairs of candidate codebooks and quantized candidate gains to minimize a mean square error.

8. The method as set forth in claim 7, wherein a time axis running from 1 to Lc−1 corresponding to the first subframe selected in said step of determining said candidate codebooks and quantized candidate codebook gains becomes "0".

9. The method as set forth in claim 1, wherein said step for selecting an optimal codebook and codebook gain further comprises the steps of:

multiplying all possible codebook gains (Gq2$_b$) by codebook candidates for said second subframe;

multiplying all possible quantized gains (Gq1$_a$) by said output signal of the step of calculating K target signals for said second subframe and adding an output signal of said multiplying step to its result; and calculating a difference value between said target signal for a window and the output signal of said adding step and selecting an optimal codebook and an optimal gain to minimize a mean square error.

* * * * *